US006752270B1

(12) United States Patent
Helsloot et al.

(10) Patent No.: US 6,752,270 B1
(45) Date of Patent: Jun. 22, 2004

(54) PACKAGING FOR LONG-STEMMED FLOWERS

(75) Inventors: Joannes Carolus Antonius Helsloot, 'S Hertogenbosch (NL); Janus Adriaan Willem De Pagter, Dinteloord (NL)

(73) Assignee: Pagter & Partners International B.V., Dinteloord (NL)

( * ) Notice: Subject to any disclaimer, the term of this patent is extended or adjusted under 35 U.S.C. 154(b) by 0 days.

(21) Appl. No.: 09/979,744

(22) PCT Filed: May 26, 2000

(86) PCT No.: PCT/NL00/00367

§ 371 (c)(1),
(2), (4) Date: Feb. 28, 2002

(87) PCT Pub. No.: WO00/73171

PCT Pub. Date: Dec. 7, 2000

(30) Foreign Application Priority Data

May 27, 1999 (NL) ..... 1012164

(51) Int. Cl.[7] ..... B65D 85/50; A01G 5/00

(52) U.S. Cl. ..... 206/423; 47/41.01

(58) Field of Search ..... 206/423, 503, 206/508, 512, 733, 736, 745, 756, 763–765, 204.1, 822; 47/84, 41.01, 41.12, 63, 41.11

(56) References Cited

U.S. PATENT DOCUMENTS 2,087,259 A 7/1937 Mortenson
2,763,134 A 9/1956 McDonald
5,060,799 A * 10/1991 De Pagter ..... 206/423
6,474,017 B1 * 11/2002 White ..... 47/41.01
6,581,330 B1 * 6/2003 Helsloot et al. ..... 47/84

FOREIGN PATENT DOCUMENTS

| | | | |
|---|---|---|---|
| FR | 2463075 | 2/1981 | |
| FR | 2614608 A1 * | 11/1988 | ..... B65D/85/50 |
| NL | 7016433 | 4/1972 | |
| NL | 8105215 | 6/1983 | |
| NL | 189398 | 10/1987 | |
| NL | DM 017718 | 9/1990 | |
| NL | 1002176 | 7/1997 | |
| NL | 1009100 | 11/1999 | |

OTHER PUBLICATIONS

International Search Report dated Sep. 8, 2000.

* cited by examiner

*Primary Examiner*—Mickey Yu
*Assistant Examiner*—Greg Pickett
(74) *Attorney, Agent, or Firm*—Kirkpatrick & Lockhart LLP; Anthony H. Handal

(57) ABSTRACT

A packaging for long-stemmed flowers having little or no leaf, in particular gerberas, anthuriums and arum lilies, comprises: at least one or more vases (2) made of flexible or rigid material, means for positioning said vase or vases (2), one or more display tubes (3) with rows of openings (17) which allow the stems of the packed flowers to pass through, but not the flowers themselves, means for positioning the display tubes (3) above the vases (2) in such a way that the flower stems inserted through the openings in the display tubes (3) extend into the vases, a tubular protective collar (4) and means for positioning the protective collar (4) around the display tubes. Preferably the packaging also has a lid (5) that fits on the protective collar and contains ventilation openings.

31 Claims, 5 Drawing Sheets

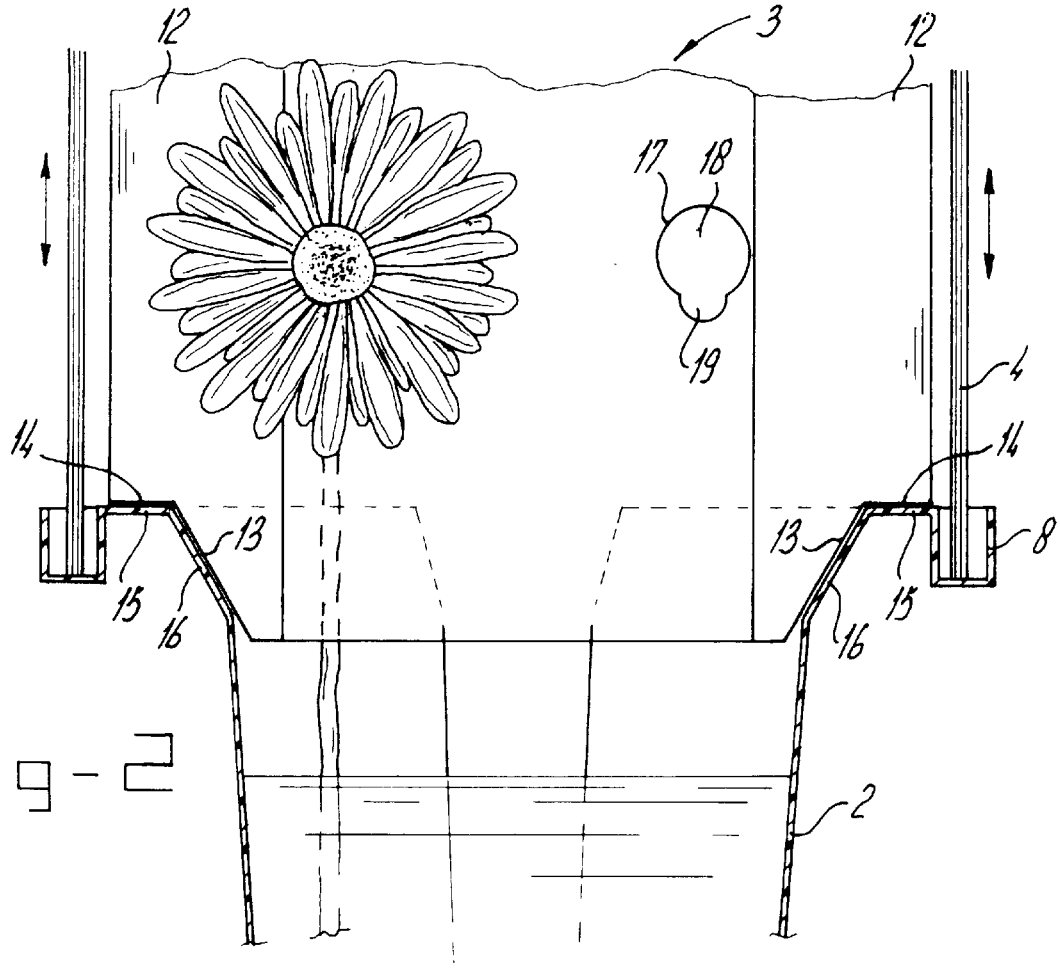
fig-2
fig-3
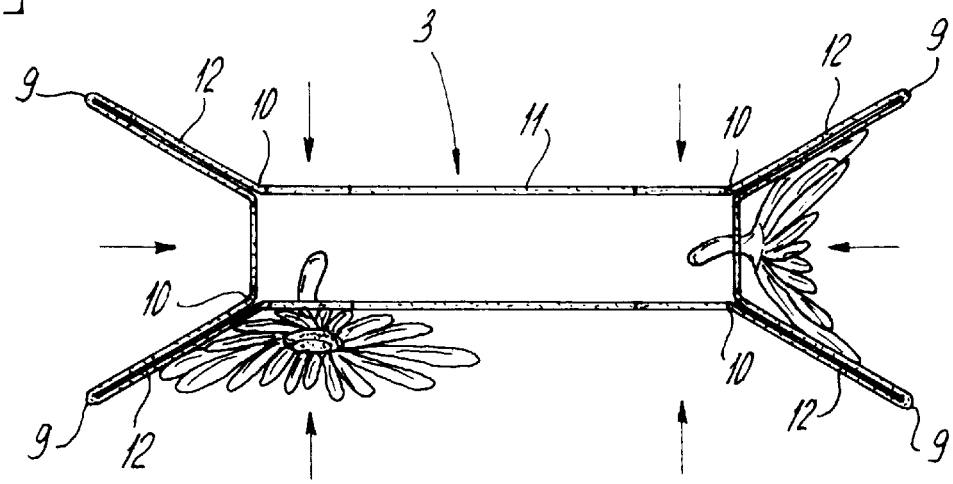

17
3
12
12
33
34
33
35
VII
32
36
31
36
30
24
VII
34
33
31
32
27
2

PACKAGING FOR LONG-STEMMED FLOWERS

The invention relates to a packaging for long-stemmed flowers having little or no leaf, in particular gerberas, anthuriums and arum lilies.

Inventors have turned their attention to the packaging of gerberas (so-called Cupping) in such a way that they are not damaged and do not wilt during transport. It is not uncommon to pack gerberas dry inside boxes. Wilting occurs relatively rapidly. It is also known to pack gerberas in a film sleeve and to place a number of flowers packed in this way in a bucket partially filled with water. The sleeve prevents damage to the flower heads. This method is labour intensive, whilst it takes a considerable time for the petals to return to an approximately horizontal position.

A packaging box for flowers with which the flowers are inserted through holes in the interior and the stems are guided into the horizontal position over the base is described in Netherlands Patent Application 7016433 and Netherlands Patent 189398. The boxes are completely closed, so that no ventilation takes place, as a result of which the formation of mould occurs relatively frequently.

The design filed under no. DM/017718 shows a flower packaging consisting of four conical vases which are to be filled with water and which are joined to one another by a common plate at their tops. To stabilise the flowers, an inlay is placed on the vases and the whole is placed in a cardboard box. The degree of loading leaves something to be desired and the flowers are not ventilated.

Another disadvantage is that the undersides of the vases are able to move relative to one another. If the base of one vase bends towards the other vases, the packaging can tip over. If the flower packaging according to DM/017718 is placed in a cardboard box, the box, which is necessarily moisture-absorbent, will have absorbed so much moisture that it becomes limp. There is no ventilation.

The transporting of gerberas in the vertical position in a container consisting of two vases with holes through which the stems of the flowers protrude is described in "Flower Trade Journal", Apr. 1996. With this arrangement the flowers are inadequately protected during transport and the degree of loading is poor.

The aim of the invention is to avoid the disadvantages of known packaging while maintaining the advantages thereof. In particular, an aim of the invention is to provide a stackable packaging suitable for gerberas and the like with which the stems can stand in water, the flowers are optimally protected, the degree of loading is high, the components of the packaging can be returned to the sender taking up as little room as possible and the flowers can be well presented at auction or in the shop.

According to the invention, to this end the packaging comprises:

- at least one or more vases made of flexible or rigid material which are positioned by means of auxiliary means,
- one or more display tubes with rows of openings which allow the stems of the packed flowers to pass through, but not the flowers themselves,
- means for positioning the display tubes above the vases in such a way that the flower stems inserted through the openings in the display tubes extend into the vases,
- a tubular protective collar and means for positioning the protective collar around the display tubes.

In a first embodiment the vases together form a watertight nestable container with a peripheral channel projecting outwards, for accommodating the bottom edge of the protective collar, extending around the uppermost part thereof In a second embodiment the vases extend through openings in a tray which is fixed to a peripheral edge of a nestable container, which container surrounds the vases and is intended to position the vases and, if the vases are made of flexible material, to support them.

The means for positioning the display tubes can consist of projections, located on the top surface of the tray, in which cuts have been made to accommodate flanges of the display tubes, which flanges project outwards.

The means for positioning the display tubes can also consist of supporting ribs projecting from the top surface of the tray.

The vases can be detachably fixed to parts of the tray by means of elastic bands. Another possibility is that the vases are fixed, at the tops thereof, by rigid rings, or to projections on said rings, which have been arranged on the tray.

The lid will preferably have been provided with ventilation openings and with a number of ridges projecting upwards, within which a container of a subsequent flower packaging, stacked on top, fits.

Preferably, in the effective folded position, each display tube consists of a rectangular tube and projecting ribs at each of the confers of said tube.

The bottom edges of the projecting ribs of this display tube can have been chamfered from a horizontal outermost part, the uppermost part of the container having, successively, working from said peripheral channel, a horizontal part directed inwards and a sloping part.

The openings in the display tubes consist of two circular cut-outs which intersect one another and have a different diameter, the circular cut-out of smaller diameter opening into the bottom part of the circular cut-out of larger diameter.

The invention also relates to a display tube intended for the packaging according to the invention.

The invention will now be explained in more detail with reference to the figures.

FIG. 2 shows a vertical section along the line II—II in FIG. 1.

FIG. 3 shows a top view of the display tube in the embodiment according to FIGS. 1 and 2 in the display position.

Figure 1:
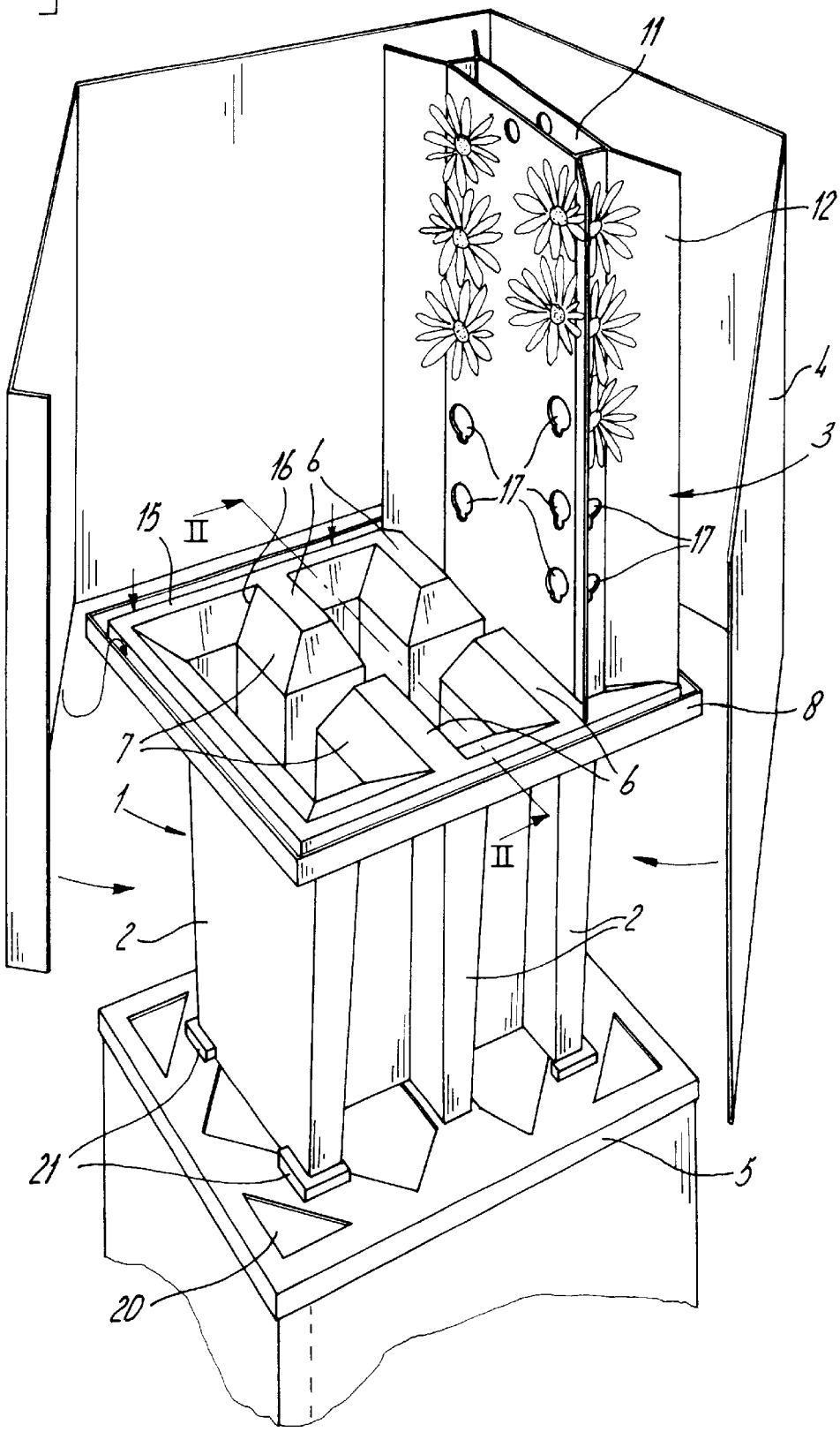
FIG. 1 shows a perspective view of a first embodiment of a flower packaging according to the invention, without lid and with exposed protective collar and only one display tube, the packaging being stacked on the lid of an underlying packaging.

The packaging shown in FIGS. 1 to 3 for long-stemmed flowers possessing little or no leaf, such as gerberas, comprises a container 1 formed by three flat vases 2, a display tube 3, placed on each of the vases, a tubular protective collar 4, arranged around the display tube, and a lid 5. In FIG. 1 the lid of the top packaging has been omitted, but the container 1 is shown in a position in which it has been placed on the lid 5 of an underlying packaging.

The three flat vases 2 are placed in a row one after the other. In cross-section the vases are rectangular and the walls are tapered such that the containers are nestable.

The vases are in communication with one another by means of channels which are located between indented parts 6 which are positioned opposite one another and are delimited at the top by sloping side walls 7.

A U-shaped peripheral edge 8 which projects outwards is arranged around the top part of the container 1.

The display tubes 3 consist of a rectangular tube with fold lines 9 at the corners such that the tubes can easily be folded to give an article that can be transported flat. Two scored lines 10 have been made in each of the side faces, as a result of which the tube can be folded into the display position according to FIGS. 1 and 3, that is to say with a relatively small rectangular tube 11 and four double-folded flanges 12 projecting obliquely outwards from the corner points thereof.

The underside of each of the flanges 12 is formed with a sloping part 13 and a horizontal part 14. In the display position of the tubes the horizontal part 14 bears on a horizontal part 15 of a vase, which horizontal part 15 abuts the inside of the channel 8, and the sloping part 13 bears on a sloping part 16 of a vase.

The display tube can preferably assume three positions:

1. the empty transport position in which it is folded flat
2. the fill position: in this position it is a large, wide open tube. This provides a great deal of room for inserting the flower stems easily through the holes. A possible embodiment is that the tubes are provided with holes at the top by means of which they can optionally be suspended from a rotary holder and as a result of which they can easily be grasped.
3. the filled transport and display position: in this position the tube is a relatively narrow rectangular tube with four double-folded flanges projecting obliquely outwards from the corner points.

The display tube can also be shaped directly into the display position if the rectangular space 11 is sufficiently large to allow the stems to be inserted in the rectangular tube, so that the fill position is omitted.

Vertical rows of openings 17 through which a stem of a gerbera or the like is inserted have been made in the walls of the tube 11. The flowers cannot penetrate through these openings and remain easily visible in contact with a side wall of the tube. The openings 17 consist of two intersecting cut-outs: a circular cut-out 18 of relatively large diameter and a circular cut-out 19 of relatively small diameter. The small cut-out intersects the large cut-out at the bottom part thereof, so that a flower stem is stably accommodated in the circular cut-out of smaller diameter after it has easily been inserted through an opening 17.

As soon as a display tube has been provided with flowers it is placed on a vase 2. FIG. 2 shows how a flower stem extends into the water in a vase 2. It will be clear that the stems extending into the water have a stabilising influence on the position of the display tube. The display tubes can thus assume three positions: the transport position, that is to say the position in which they are folded flat and in which the tubes are transported to the grower or trader, the fill position, in which the tubes are filled with flowers, and the transport position, in which the tubes filled with flowers are transported to the retailer.

After a display tube, with flowers, has been placed on each of the three vases 2, a protective collar 4 is fitted with its bottom end in the U-shaped channel 8 of the container 1. Finally, a lid 5 is fitted on the collar 4. During transport one or more plastic straps can be wrapped around each pack individually or around a number of packs stacked on a pallet. The number of display tubes 3 does not have to correspond to the number of vases 2. It would be possible to use six display tubes on three vases for gerberas with small flowers. For proteas it would be possible to use only one display tube for several vases. For callas and anthuriums two display tubes could possibly be used per three or more vases.

Ventilation openings 20 have been cut in the lid and four L-shaped ridges 21 have been made on the lid. As can be seen in FIG. 1, the undersides of the vases 2 of an upper pack fit accurately into the space delimited by the ridges 21 of the lid 5 of a lower pack. Trapezium-shaped ridges according to NL-A 1 009 100 could be used instead of the L-shaped ridges 21.

Figure 4:
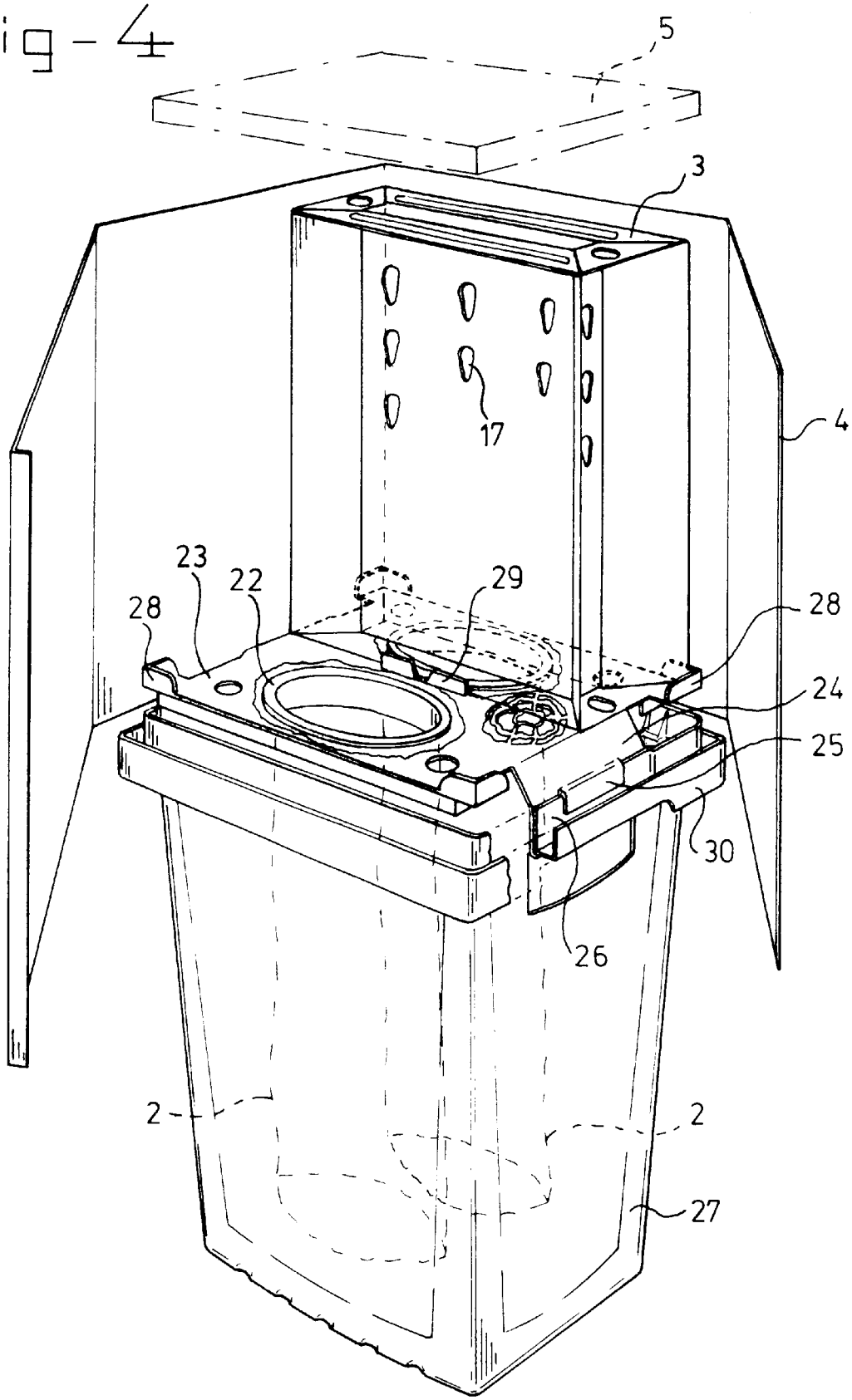
FIG. 4 shows a perspective view of a second embodiment.

The second embodiment according to FIG. 4 differs from that according to FIGS. 1 to 3 in that the vases 2 consist of flexible film bags or of detachable vases made from a rigid material, the top edge of each of which is wrapped over a ring 22 and fixed in place, which ring bears on a tray 23 that bears by means of two supports 24, located opposite one another and each having a lip 25, on a peripheral edge 26 of a rectangular container 27. The film vases 2 are thus in the container 27, which serves to position the vases.

L-shaped ribs 28 have been formed at the corners of the tray 23 and a straight rib 29 has been formed in the middle of tray 23. Said ribs 28 and 29 serve for positioning of two display tubes 3 on the tray 23. In the effective position, the protective collar 4, which for the sake of clarity has been drawn in the unfolded position, rests on the bottom of a channel 30 which forms part of the peripheral wall of the container 27. Said peripheral wall 26 is one of two upright edges of the channel 30.

Figure 5:
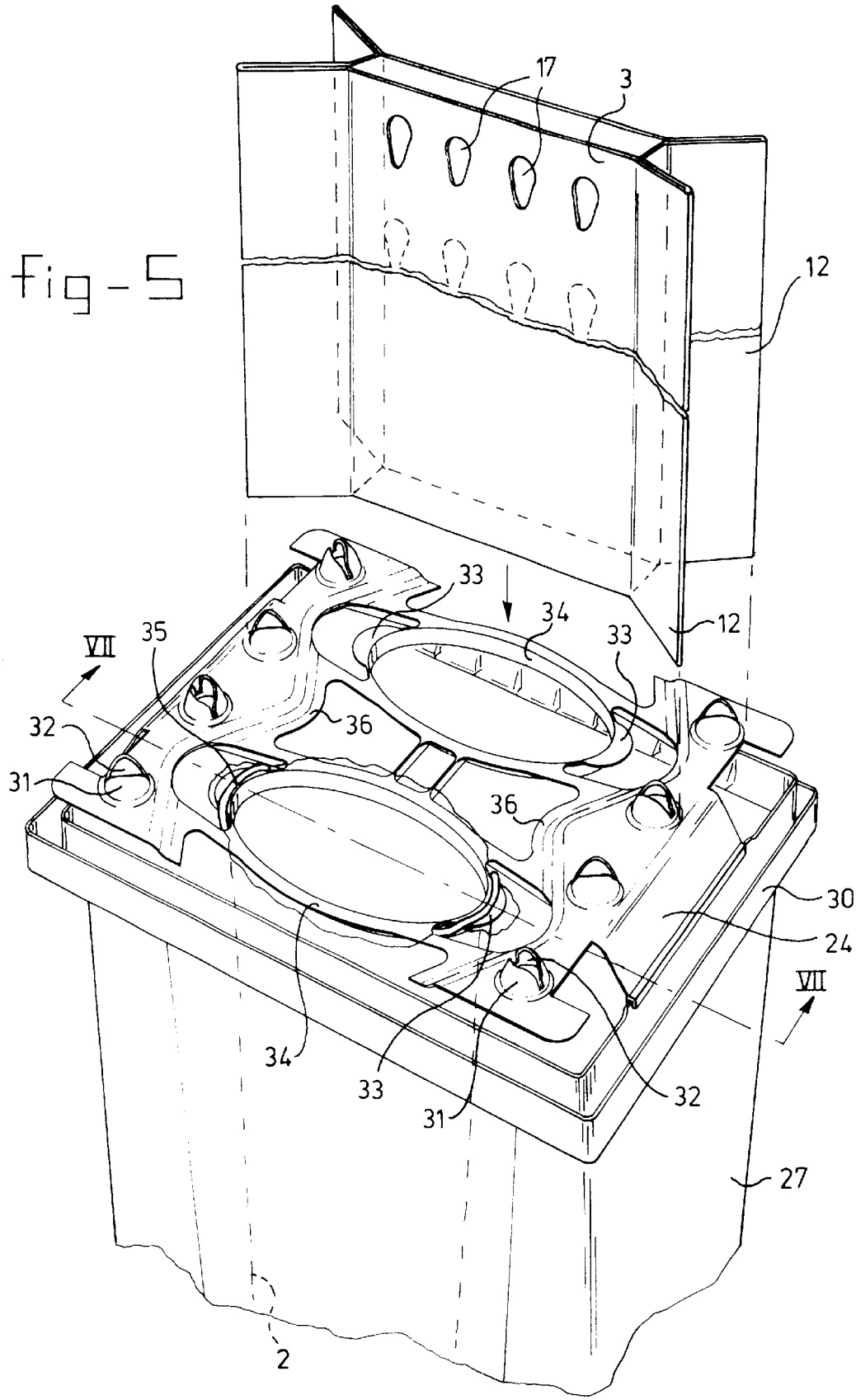
FIG. 5 shows a perspective view of a third embodiment.
Figure 7:
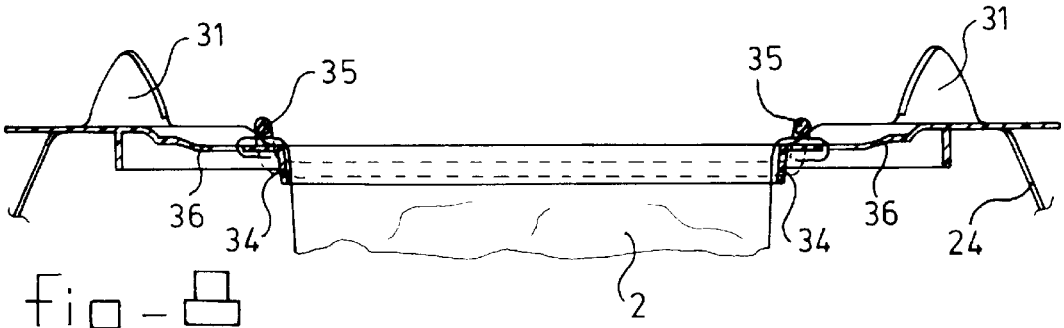
FIG. 7 is a section along the line VII—VII in FIG. 5.

The third embodiment according to FIGS. 5 and 7 differs from that according to FIG. 4 in that the tray 23 is provided with upright projections 31 having cuts 32 for accommodating the outwardly projecting flanges 12 of the display tubes 3 which are positioned by this means.

The tray 23 also has two pairs of lips 33, each pair of which are located opposite one another and abut a ring 34 of L-shaped cross-section, each of which rings surrounds an oval-shaped opening in the tray 23. The top edges of the film vases 2 are wrapped over the ring 34 and are held in place by an elastic band 35. This elastic band 35 extends over a vertical part of the L-shaped ring 34. The two ends of the top edges of the film vases 2 can also be provided with two or more holes, which are fitted over the lips 33, by which means the film vases 2 are detachably fixed to tray 23 without the use of an elastic band.

To counteract the bottom edge of the display tubes 3 becoming wet, the tray 23 has somewhat recessed parts 36.

Figure 6:
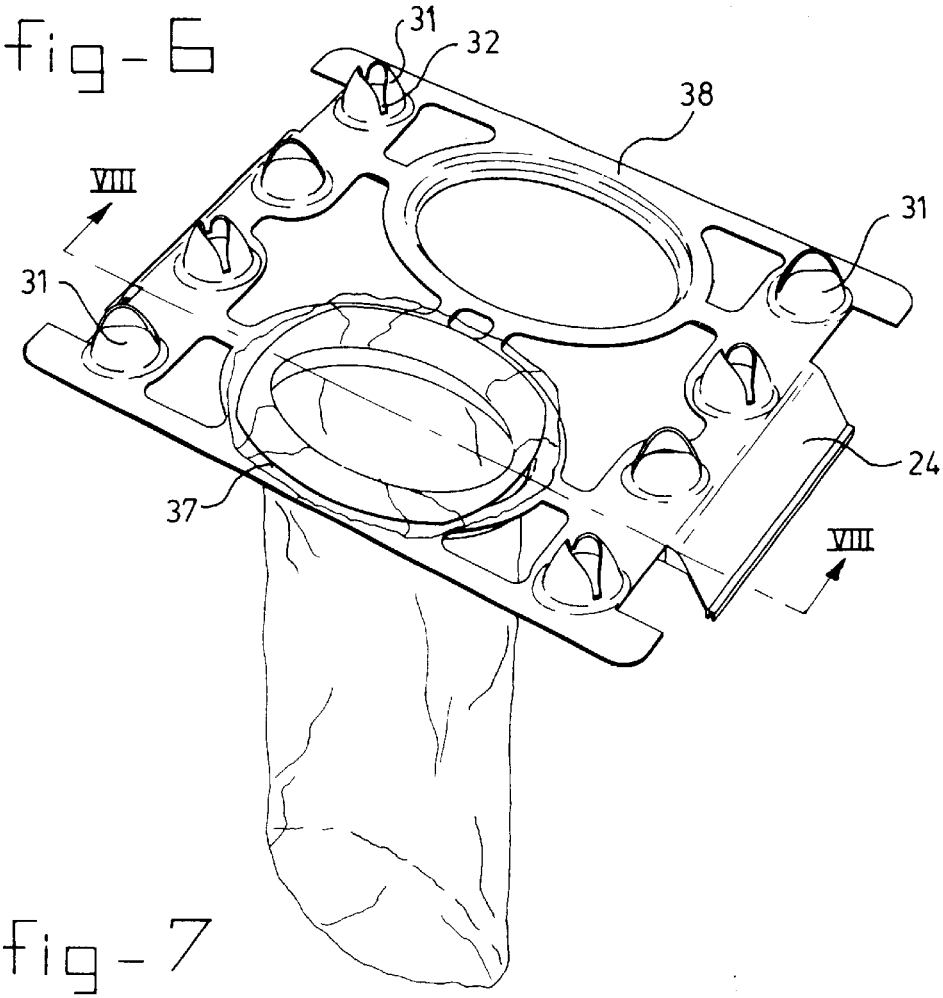
FIG. 6 shows a perspective view of a fourth embodiment.
Figure 8:
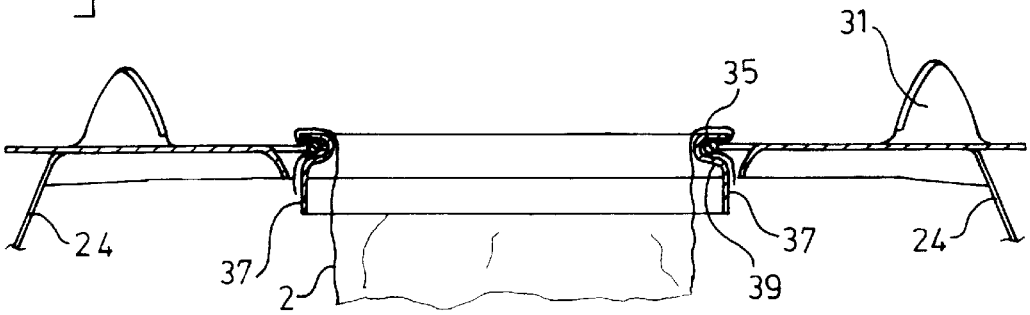
FIG. 8 is a section along the line VIII—VIII in FIG. 6.

The embodiment according to FIGS. 6 and 8 differs from that according to FIGS. 5 and 7 in that the top edge of each of the film vases 2 is attached by means of an elastic band 35 to a separate ring 37 and a horizontal section bears on a horizontal edge 38 of the boundary of an annular opening in the tray 23. The elastic band 35 is in a concave rounding 39 in the ring 37.

The most important advantages of the packaging described are:

- that there are fewer losses during transport of the flowers,
- that the packaging not only provides ventilation but is also stackable,
- that the flowers can remain fresh for longer in the packaging,
- that the degree of loading (number of flowers per unit volume) of lorries that is associated with the shape of the display tubes is relatively high,
- that the flowers are in water and humid air can escape,
- that the flowers are well protected against damage during transport,
- that the flowers can easily rapidly be made visible without being removed from the packaging, for example during auctioning and in the shop, that there is no longer a need to trim the flowers at the destination and place them on iron wire and to allow the flowers to suck up all the water they can take, that relatively little water has to be contained in the packaging, that if, as is the case with the first embodiment, the vases are in communication with one another, filling has to be carried out at one place only.

Of course, other variants are conceivable within the scope of the invention.

What is claimed is:

1. Packaging for long-stemmed flowers having little or no leaf, the packaging comprising:

a) at least one vase made of flexible or rigid material;

b) at least one display tube, the display tube having multiple rows of flower openings configured to pass the stems of the packed flowers but not the flowers themselves;

c) one or more display tube positioning members to position the at least one display tube above the at least one vase so that flower stems inserted through the flower openings in the at least one display tube can extend into the at least one vase;

d) a tubular protective collar to extend around the at least one display tube; and e) one or more protective collar positioning members to position the protective collar around the at least one display tube.

2. Packaging according to claim 1, further comprising a lid for the protective collar, the lid optionally having ventilation openings.

3. Packaging according to claim 1, comprising a plurality of vases wherein the vases together form a watertight nestable container, the container has a peripheral channel projecting outwardly of the container and the protective collar has a bottom edge, the bottom edge of the collar being accommodatable in the container peripheral channel.

4. Packaging according to claim 2, comprising a nestable container to surround and position the at least one vase, the container having a peripheral edge and comprising a tray supportable on the container, the tray having one or more vase openings to receive the vase or vases.

5. Packaging according to claim 4, wherein the or each display tube has outwardly projecting flanges, the protective collar positioning members comprise projections located on the top surface of the tray and wherein the projections have cuts to accommodate the display tube flanges.

6. Packaging according to claim 4, wherein the display tube positioning members comprise supporting ribs projecting from the top surface of the tray.

7. Packaging according to claim 4, wherein the tray comprises a lip adjacent the or each vase opening and wherein the or each vase is fabricated of flexible material and has an open mouth to fit over the or one of the lips in order detachably to fix the vase or vases to the tray.

8. Packaging according to claim 7, comprising one or more rigid rings, one for the or each vase, the rigid ring or rings bearing on the tray adjacent the vase openings therein, wherein the or each mouth of the or each vase is attached to one of the rigid rings.

9. Packaging according to claim 4, comprising an elastic band for the or each vase to secure the or each vase to support members on the tray.

10. Packaging according to claim 2, wherein the lid has ventilation openings.

11. Packaging according to claim 2, wherein the lid can support and locate a similar packaging stacked on top of the claimed packaging, the lid optionally having a number of upwardly projecting ridges within which the similar packaging clan fit.

12. Packaging according to claim 2, wherein the or each display tube can be folded into a configuration wherein the display tube comprises a rectangular tube and a plurality of flanges, one flange projecting from each corner of the display tube.

13. Packaging according to claim 3, comprising a plurality of vases wherein the vases together form a watertight nestable container, the container has a peripheral channel projecting outwardly of the container and the protective collar has a collar bottom edge, the collar bottom edge being accommodatable in the container peripheral channel wherein the display tube projecting flanges have chamfered bottom edges, the chamfering tapering downwardly and inwardly from a horizontal outermost point of the flange and wherein the uppermost part of the container has, inwardly of said peripheral channel, a horizontal inwardly extending and downwardly sloping portion to accommodate the flange chamfering.

14. Packaging according to claim 2, wherein each flower opening in the or each display tube comprises a larger cutout and a smaller cut-out beneath and opening into the larger cut-out, wherein the larger cutout can receive but not pass a flower head and the smaller cutout can receive a flower stem.

15. Packaging according to claim 2, wherein each flower opening in the or each display tube comprises two circular, intersecting cutouts of differing diameters, the smaller diameter cut-out opening into a bottom part of the larger diameter circular cut-out.

16. Packaging according to claim 2, wherein the at least one display tube is positioned above the at least one vase, the packaging further comprising long-stemmed flowers and water in the vases, wherein the flowers are positioned with their stems extending through the display tube openings into the water.

17. Packaging according to claim 15 wherein the flowers are, or comprise, gerberas, anthuriums or arum lilies.

18. A display tube for use in the packaging according to claim 1 being a display tube having multiple rows of flower openings configured to pass the stems of the packed flowers but not the flowers themselves the display tube being fabricated from folded sheet material and being foldable to provide a flat article, the display tube comprising a rectangular tube having four double-folded essentially planar flanges projecting outwardly from the corners of the rectangle, the flower openings being present in portions of the display tube comprising walls of the rectangle.

19. A display tube according to claim 18, wherein the display tube projecting flanges have chamfered bottom edges, the chamfering tapering downwardly and inwardly from a horizontal outermost point of the flange with respect to an upright position of the display tube.

20. Packaging for long-stemmed flowers having little or no leaf, the packaging comprising:

a) a plurality of vases positionable one beside the other and made of flexible or rigid material;

b) a plurality of display tubes, one for each vase, each display tube having multiple rows of flower openings configured to pass the stems of the packed flowers but not the flowers themselves;

c) display tube positioning members to position the display tubes above the vases with each display tube in alignment with one of the vases so that flower stems inserted through the flower openings in each display tube can extend into the vases;

d) a tubular protective collar to extend around the display tubes;

e) a collar positioning member to position the protective collar around the display tubes; and f) a lid for the protective collar, the lid optionally having ventilation openings.

21. Packaging according to claim 20, wherein the vases together form a watertight nestable container, the container has a peripheral channel projecting outwardly of the container, the protective collar has a bottom edge, the bottom edge of the collar being accommodatable in the container peripheral channel and, optionally, the container includes a watering channel extending between the vases to facilitate watering.

22. Packaging according to claim 20, comprising a nestable container to surround and position the vases, the container having a peripheral edge and comprising a tray supportable on the container, the tray having one or more vase openings to receive the vase or vases.

23. Packaging according to claim 20, wherein each display tube has outwardly projecting flanges, the protective collar positioning members comprise projections located on the top surface of the tray and wherein the projections have cuts to accommodate the display tube flanges.

24. Packaging according to claim 23, wherein the tray comprises a lip adjacent each vase opening and wherein each vase is fabricated of flexible material and has an open mouth to fit over the lips in order detachably to fix each vase to the tray, the packaging optionally comprising an elastic band for each vase to secure the vase mouth around the respective vase opening.

25. Packaging according to claim 23, comprising a plurality of rigid rings, one for each vase, the rigid ring or rings bearing on the tray adjacent the vase openings therein, wherein each mouth of each vase is secured by one of the rigid rings.

26. Packaging according to claim 20, wherein the lid can support and locate a similar packaging stacked on top of the claimed packaging, the lid optionally having a number of upwardly projecting ridges cooperative to receive and locate the similar packaging.

27. Packaging according to claim 20, wherein each display tube can be folded into a configuration wherein the display tube comprises a rectangular tube and a plurality of flanges, one flange projecting from each corner of the display tube.

28. Packaging according to claim 21, comprising a plurality of vases wherein the vases together form a watertight nestable container, the container has a peripheral channel projecting outwardly of the container and the protective collar has a collar bottom edge, the collar bottom edge being accommodatable in the container peripheral channel wherein the display tube projecting flanges have chamfered bottom edges, the chamfering tapering downwardly and inwardly from a horizontal outermost point of the flange and wherein the uppermost part of the container has, inwardly of said peripheral channel, a horizontal inwardly extending and downwardly sloping portion to accommodate the flange chamfering.

29. Packaging according to claim 20, wherein each flower opening in each display tube comprises a larger cutout and a smaller cut-out beneath and opening into the larger cut-out, wherein the larger cutout can receive but not pass a flower head and the smaller cutout can receive a flower stem.

30. Packaging according to claim 20, wherein the display tubes are positioned above the vases, the packaging further comprising long-stemmed flowers and water in the vases, wherein the flowers are positioned with their stems extending through the display tube openings into the water.

31. Packaging according to claim 30 wherein the flowers are, or comprise, gerberas, anthuriums or arum lilies.

* * * * *